US011697883B2

(12) United States Patent
Austenfeld

(10) Patent No.: US 11,697,883 B2
(45) **Date of Patent: *Jul. 11, 2023**

(54) ELECTROLYSIS CELL HAVING RESILIENT HOLDING ELEMENTS

(71) Applicant: thyssenkrupp nucera AG & Co. KGaA, Dortmund (DE)

(72) Inventor: Sebastian Austenfeld, Soest (DE)

(73) Assignee: THYSSENKRUPP NUCERA AG & CO. KGAA, Dortmund (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/852,894

(22) Filed: Jun. 29, 2022

(65) Prior Publication Data

US 2022/0325427 A1 Oct. 13, 2022

Related U.S. Application Data

(63) Continuation of application No. 15/733,939, filed as application No. PCT/EP2019/065393 on Jun. 12, 2019, now Pat. No. 11,479,870.

(30) Foreign Application Priority Data

Jun. 14, 2018 (DE) ..... 10 2018 209 520.5

(51) Int. Cl.
*C25B 9/65* (2021.01)
*C25B 9/77* (2021.01)
(Continued)

(52) U.S. Cl.
CPC ..... *C25B 9/65* (2021.01); *C25B 1/26* (2013.01); *C25B 1/46* (2013.01); *C25B 9/19* (2021.01);
(Continued)

(58) Field of Classification Search
None
See application file for complete search history.

(56) References Cited

U.S. PATENT DOCUMENTS 3,873,437 A 3/1975 Pulver
4,017,375 A 4/1977 Pohto
(Continued)

FOREIGN PATENT DOCUMENTS

CN 1564878 A 1/2005
DE 102 54 379 A 6/2004
(Continued)

OTHER PUBLICATIONS

English Translation of International Search Report issued in PCT/EP2019/065393, dated Sep. 30, 2019.

*Primary Examiner* — Harry D Wilkins, III
(74) *Attorney, Agent, or Firm* — thyssenkrupp North America, LLC

(57) ABSTRACT

An electrolysis cell includes an anode chamber and a cathode chamber separated by an ion-exchange membrane. The electrolysis cell includes an anode, a cathode, and a cathode current distributor. The anode, the ion-exchange membrane, the cathode, and the cathode current distributor are in direct touching contact in the mentioned order. Flexibly resilient holding elements are arranged on the other side of the anode and/or on the other side of the cathode current distributor. The flexibly resilient holding elements exert a contact pressure on the anode and/or on the cathode current distributor. The flexibly resilient holding elements have annular elements, the axis of which is oriented in the height direction of the electrolysis cell. By means of the flexibly resilient and in part also plastically deforming annular elements, effective mechanical contact pressure of the ion-exchange membrane against the oxygen-depolarized cathode is achieved.

18 Claims, 8 Drawing Sheets

(51) Int. Cl.

| | |
|---|---|
| ***C25B 9/75*** | (2021.01) |
| ***C25B 9/23*** | (2021.01) |
| ***C25B 9/19*** | (2021.01) |
| ***C25B 1/26*** | (2006.01) |
| ***C25B 1/46*** | (2006.01) |

(52) U.S. Cl.
CPC ..... *C25B 9/23* (2021.01); *C25B 9/75* (2021.01); *C25B 9/77* (2021.01)

(56) References Cited

U.S. PATENT DOCUMENTS

| | | | | |
|---|---|---|---|---|
| 4,605,482 | A | 8/1986 | Shiragami et al. | |
| 4,664,770 | A | 5/1987 | Schmitt | |
| 4,736,932 | A | 4/1988 | Haslim | |
| 5,194,132 | A | 3/1993 | Hartmann et al. | |
| 5,221,452 | A | 6/1993 | Nakao et al. | |
| 6,495,006 | B1 | 12/2002 | Kimura et al. | |
| 7,048,838 | B2 | 5/2006 | Katayama et al. | |
| 7,399,391 | B2 | 7/2008 | Oldani et al. | |
| 7,670,472 | B2 | 3/2010 | Faita et al. | |
| 7,763,152 | B2 | 7/2010 | Suzuki et al. | |
| 8,372,255 | B2 | 2/2013 | Perego et al. | |
| 9,062,383 | B2 | 6/2015 | Ottaviani et al. | |
| 9,297,085 | B2 | 3/2016 | Kitaori et al. | |
| 9,476,130 | B2 | 10/2016 | Suemoto et al. | |
| 9,506,157 | B2 | 11/2016 | Funakawa et al. | |
| 9,797,051 | B2 | 10/2017 | Federico et al. | |
| 10,208,388 | B2 | 2/2019 | Hatano et al. | |
| 11,479,870 | B2 * | 10/2022 | Austenfeld | C25B 9/65 |
| 2007/0020505 | A1 | 1/2007 | Grafl | |
| 2007/0231619 | A1 | 10/2007 | Strobel et al. | |
| 2009/0050472 | A1 | 2/2009 | Federico | |
| 2009/0071820 | A1 | 3/2009 | Saiki | |
| 2009/0236220 | A1 * | 9/2009 | Woltering | C25B 1/46 204/252 |
| 2017/0037522 | A1 | 2/2017 | Kaczur et al. | |

FOREIGN PATENT DOCUMENTS

| | | | |
|---|---|---|---|
| DE | 10 2007 042 171 | A | 3/2009 |
| EA | 19177 | B1 | 1/2014 |
| EA | 28920 | B1 | 1/2018 |
| JP | S61-290246 | A | 12/1986 |
| JP | S64-49728 | | 2/1989 |
| JP | 2005-509744 | A | 4/2005 |
| JP | 2012-140654 | A | 7/2012 |
| RU | 2069708 | C1 | 11/1996 |
| RU | 2304638 | C2 | 8/2007 |
| RU | 2455395 | C2 | 7/2012 |
| RU | 2575343 | C1 | 2/2016 |
| WO | 84/02537 | A1 | 7/1984 |
| WO | 2003/014419 | A | 2/2003 |
| WO | 2013/141211 | A1 | 8/2015 |
| WO | 2015/068579 | A1 | 3/2017 |
| WO | 2017217427 | A | 12/2017 |

* cited by examiner

ELECTROLYSIS CELL HAVING RESILIENT HOLDING ELEMENTS

CROSS REFERENCE TO RELATED APPLICATIONS

This application is a continuation application of U.S. patent application Ser. No. 15/733,939, filed Dec. 1, 2020, which is a U.S. National Stage Entry of International Patent Application Serial Number PCT/EP2019/065393, filed Jun. 12, 2019, which claims priority to German Patent Application No. DE 10 2018 209 520.5, filed Jun. 14, 2018, the entire contents of all of which are incorporated herein by reference.

FIELD

The present disclosure generally relates to electrolysis cells.

BACKGROUND

Various designs for achieving a so-called "zero-gap" configuration, in which the anode electrode and the cathode electrode are in direct contact with the membrane, are known from NaCl technology (chlor-alkali electrolysis). These concepts operate with a current transfer between rigid and flexible nickel components by touching contact. However, owing to the corrosive conditions in a HCl-ODC cell, that principle is not transferrable to this type of cell. Titanium alloys are therefore used therein, which alloys form a dense oxide layer on contact with the medium and thereby develop resistance to the medium. However, this oxide layer has an insulating effect, so that touching contact would here fail over time.

In the case of a zero-gap configuration, it is primarily expected that the elements can be operated with the same current density at a lower operating voltage. Moreover, with a lower HCl concentration on the anode side, it is expected that the operating voltage of the cells will increase less than in the case of the conventional design, since the influence of the conductivity of the medium plays a lesser role in the zero-gap configuration.

From WO 03/014419 A2 there is known an electrolysis cell for the electrochemical production of chlorine, in which an anode, a cation-exchange membrane, a gas diffusion electrode and a current collector are elastically held together so that there are no gaps between the individual components. The elastic cohesion is achieved by the current collector being elastically fixed to the cathode frame or the anode being elastically fixed to the anode frame. Holding elements are thereby used which are configured as spring elements and extend, for example, in the cathode chamber between a back wall and the current collector. Helical springs are used, which on the one hand are fastened at one end via Z-profiles to the back wall and on the other hand at their other end exert a pressing force on the current collector in their axial direction. These helical springs extend with their axial direction in the transverse direction of the electrolysis cell, that is to say perpendicular to the plane of the electrodes.

In US 2009/0050472 A1 there is described an electrolysis cell having an anode chamber and a cathode chamber which are separated from one another by an ion-exchange membrane, wherein the electrolysis cell further comprises a gas diffusion electrode. The arrangement of the individual structural elements in the electrolysis cell is such that the anode is followed by the ion-exchange membrane, then a percolator, then the cathode, an elastic current collector and the cathode back wall. The electrolysis cell is a chlor-alkali cell with an oxygen-depolarized cathode. The elastic current collector used here consists of a type of mattress of nickel. Alternatively, it is possible to use a current collector with elastic spring tags in a comb-like arrangement or with projecting spring plates fixed on one side, which push against the cathode or against the anode and press them against the ion-exchange membrane.

DE 10 2007 042 171 A1 describes an electrolysis cell in which there are provided on the anode side pneumatic contacting mechanisms which are formed of pneumatically inflatable contacting tubes. These contacting tubes are connected to a pneumatic system and are inflated to an extent necessary for contact. The contacting tubes consist of a silicone rubber and are consequently not electrically conductive. The contact pressure is generated by means of a pressurized auxiliary medium. Such contacting tubes do not consist of a material which is plastically deformable at least in part by the contact pressure.

Thus a need exists for an electrolysis cell in which effective mechanical contact pressure of the ion-exchange membrane against the oxygen-depolarized cathode is ensured in order to produce a zero-gap configuration.

DETAILED DESCRIPTION

Figure 1:
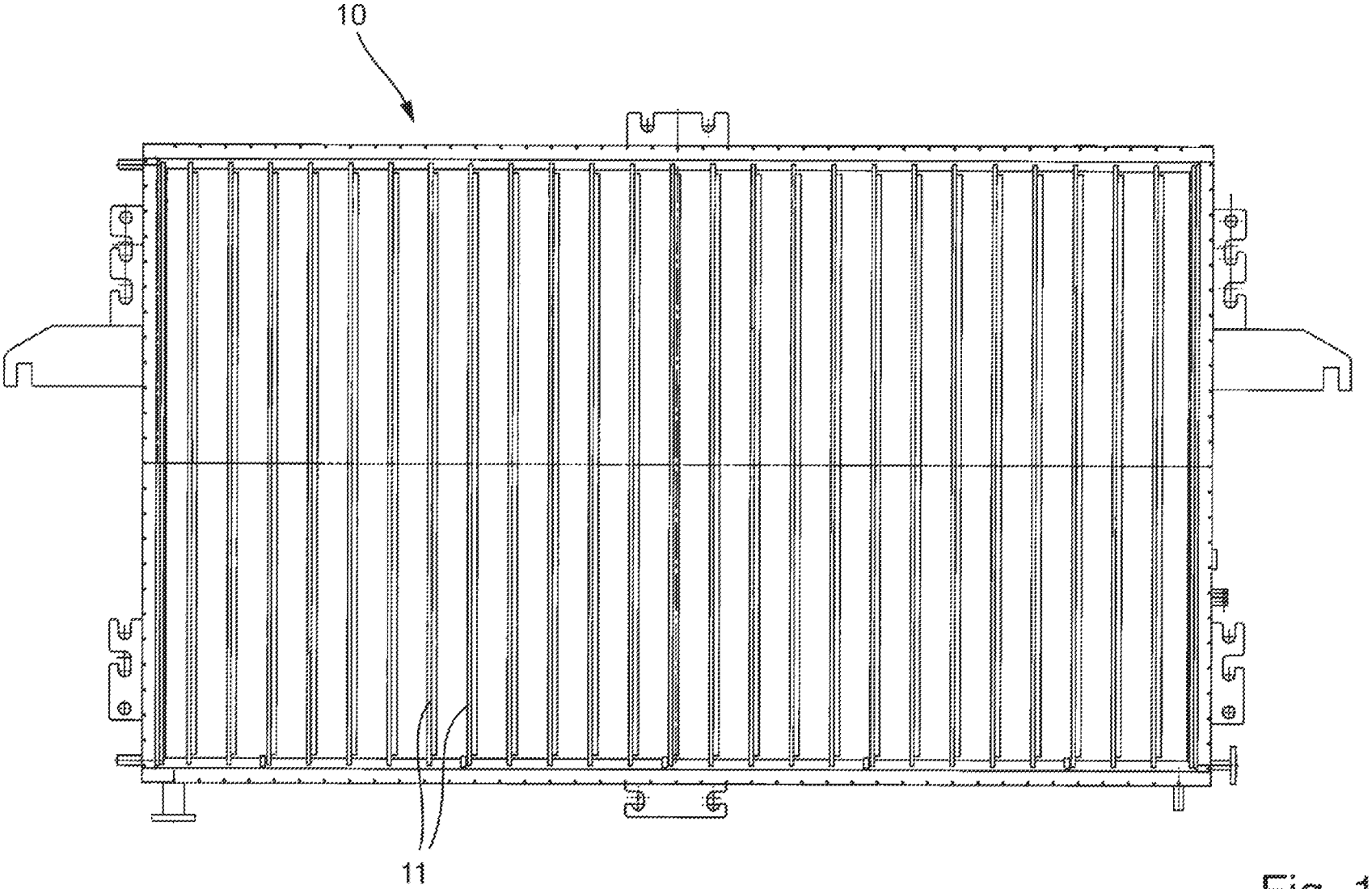
FIG. 1 is a schematically simplified view of an example of an electrolysis cell.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The present invention relates to an electrolysis cell comprising an anode chamber and a cathode chamber which are separated from one another by an ion-exchange membrane, wherein the electrolysis cell further comprises an anode, a gas diffusion electrode and a cathode current distributor, wherein the anode, the ion-exchange membrane, the gas diffusion electrode and the cathode current distributor are each in direct touching contact with one another in the stated order and wherein resilient holding elements are arranged on the other side of the anode and/or on the other side of the cathode current distributor, which resilient holding elements exert a contact pressure on the anode and/or on the cathode current distributor.

The present invention relates in particular to electrolysis cells in electrolyzers which operate according to ODC technology with an oxygen-depolarized cathode. In the production of chlorine by chlor-alkali electrolysis or hydrochloric acid electrolysis, as is conventional nowadays, the desired main product chlorine forms at the anode in accordance with the following equation:

$$2Cl^- \rightarrow Cl_2 + 2e^-$$

Hydrogen as by-product forms at the cathode according to:

$$4H_2O + 4e^- \rightarrow 2H_2 + 4OH^-$$

or, in the case of hydrochloric acid electrolysis:

$$2H^+ + 2e^- \rightarrow H_2$$

By using a gas diffusion electrode and oxygen as an additional reaction partner, the following reaction takes place in the case of hydrochloric acid electrolysis:

$$2H^+ + \tfrac{1}{2}O_2 + 2e^- \rightarrow 2H_2O$$

The present invention relates in particular to electrolysis cells for hydrochloric acid electrolysis with an oxygen-depolarized cathode (ODC), according to the equation reproduced above. In this HCl-ODC technology, electrolyzers have hitherto generally been designed with a defined gap between the anode electrode and the membrane, which as a result of process pressure lies against the oxygen-depolarized cathode. Since all the internal components of the cell were rigid in form, their tolerancing was designed for a resulting gap, in order to avoid excessive pressing.

According to the invention it is provided that the resilient holding elements comprise annular elements or at least one tubular portion, the axis of which is oriented in the height direction or in the longitudinal direction of the electrolysis cell. Accordingly, the solution according to the invention differs substantially from the prior art cited above, since in the prior art there are used resilient holding elements which are designed similarly to helical springs and which are arranged in the electrolysis cell in such a manner that their axis extends in the transverse direction of the electrolysis cell.

Moreover, the holding elements, in particular the annular elements or tubular portions thereof, undergo in the electrolysis cell, in addition to an elastic deformation, at least in part a plastic deformation and are configured to be elastoplastically resilient. Such plastic deformation occurs as a result of the contact pressure, since the annular elements or tubular portions are compression loaded in the radial direction in the electrolysis cell. The above-mentioned plastic deformation is a permanent deformation, for example a radial compression of the annular elements by radial loading. This is to be distinguished from solutions known from the prior art, in which there are used, for example, helical-spring-like elements which deform temporarily under compression but, owing to their elasticity, recover again when the compressive force decreases and accordingly assume their original form again.

The extent of the electrolysis cell in the three mutually perpendicular spatial directions is defined in the present application such that the direction parallel to the mostly planar electrodes and the planar membrane is referred to as the longitudinal direction. The direction perpendicular to the longitudinal direction, which is likewise parallel to the extent of the planar electrodes, in the electrolysis cell from the bottom end to the top end, is referred to as the height direction. The direction transverse to the electrodes, that is to say in the direction of the surface normals to the electrodes and to the membrane, and accordingly transverse to the longitudinal direction and height direction, is referred to as the transverse direction.

The electrolysis cells according to the invention can accordingly have, for example, an approximately quadrangular basic shape, wherein the extent of the electrolysis cell in the transverse direction defined above is generally smaller than the extent in the longitudinal direction. In addition, in the transverse direction, in an electrolyzer, a plurality of electrolysis cells are preferably arranged connected in series side by side or one behind the other, such that the cathode chamber of one cell is always followed by the anode chamber of the next electrolysis cell in the series connection, wherein the ion-exchange membrane is in each case arranged between the cathode chamber of the first electrolysis cell and the anode chamber of the next adjacent electrolysis cell.

A preferred further development of the problem solution according to the invention provides that the annular elements or the tubular portion of the resilient holding elements are arranged between the anode and the cathode current distributor in such a manner that they are compression loaded in the radial direction. This means that the radial direction of the annular elements corresponds in the solution according to the invention to the transverse direction of the electrolysis cell, that is to say the direction in which contact pressure of the ion-exchange membrane against the oxygen-depolarized cathode is desired. The annular element or the tubular portion is thus flexible in its radial direction. The contact pressure of the planar membrane/electrode structure is generated by a deflection of the annular elements or tubular portions in their radial direction, wherein a displacement of the electrode in the direction towards the back wall of the chamber is achieved without simultaneous lateral displacement, since the latter would give rise to the risk of damage to the membrane.

However, it is also possible within the scope of the invention, as an alternative thereto, to arrange the resilient holding elements in the electrolysis cell in the anode chamber and/or in the cathode chamber in such a manner that they extend with their axis not in the height direction but in the longitudinal direction of the electrolysis cell. In this case too, the holding elements preferably configured to be elastoplastically resilient would be compression loaded in the radial direction.

According to a further development of the invention, it is possible that the annular elements or the tubular portion of the holding elements undergo in the electrolysis cell, in addition to an elastic deformation, at least in part also a plastic deformation as a result of the contact pressure. Plastic deformation is thereby understood as meaning a permanent deformation of a material, in which the stress acting in the material exceeds the yield limit or 0.2% elastic limit of the material. In this case, the holding elements according to the present invention exhibit elastoplastic behavior. Therefore, the expressions elastoplastic holding elements and elastoplastic annular elements are also used hereinbelow in the present application. The annular elements or the tubular portions achieve the contact pressure of the planar membrane/electrode structure by elastoplastic deflection in their radial direction. This means that, when the electrolysis cell is dismantled, it can then be determined that the annular elements or the tubular portions are also permanently slightly deformed, which can optionally be corrected again, however, by a mechanical correction, that is to say, for example, a straightening operation in a workshop, so that plasticization of the annular elements or tubular portions in the electrolysis cell is then possible again.

Owing to the plastic deformation of the annular element or tubular portion at least in part, overpressing of the membrane is effectively prevented. The annular element or the tubular portion can exert only a certain maximum limit force, since permanent deformation occurs before that limit force is exceeded.

The resilient holding elements comprise annular elements or at least one tubular portion which undergo in the electrolysis cell, in addition to an elastic deformation, at least in part a plastic deformation and are configured to be elastoplastically resilient.

According to a preferred further development of the present invention, the elastoplastically resilient holding elements can have, for example, a plurality of annular elements which are arranged parallel to one another and spaced apart from one another and which are connected together. For example, the annular elements can be connected together using webs which extend in a direction perpendicular to the plane of the annular elements. Such webs permit better processability of the holding elements on assembly of the electrolysis cell, since the flexible holding elements can then be welded without interruption, for example by means of a laser, to the back wall of the anode chamber or cathode chamber and/or to the anode or the cathode. Otherwise, an additional outlay in terms of apparatus would be required.

The annular structure of the holding elements according to the invention has the further advantage that it allows accessory parts of the electrolysis cell, such as, for example, outlet pipes, to be installed in the annular space created by the annular element, for example approximately concentrically in the middle thereof.

According to a preferred further development of the invention, the annular elements have an ovalized cross-section differing from the circular shape. In particular, it is advantageous if the annular elements have a cross-section which differs from the circular shape and is flattened in two regions lying opposite one another on the circumference. Such a symmetrical cross-section ensures that the electrode (anode or cathode) is displaced only in a direction perpendicular to the surface of the electrode, that is to say in the transverse direction of the electrolysis cell. The oval shape or the shape provided with large radii additionally ensures uniform deformation. In particular in the case of plastic deformation, other geometric shapes, such as, for example, a lozenge shape, could result in considerable plasticization of the material in the vertices. This would promote crack formation, and mechanical straightening of the structure could then lead to damage at the resilient structure.

A preferred further development of the invention provides that the resilient holding elements are welded to at least one adjacent structural element of the electrolysis cell, in particular to the anode and/or to a back wall of the electrolysis cell. Welding establishes contact between the flexible holding element and the back wall of the chamber and the electrode (in particular the anode), whereby optimum low-loss current transfer is ensured. The flattened cross-section of the annular elements on both opposite sides on the circumference improves this contact, since the contact area is increased. Welding can be achieved, for example, via a laser weld seam running in the vertical direction of the holding element (height direction of the electrolysis cell).

When holding elements are used which have two or more annular elements spaced apart from one another and connected together via webs which run in the perpendicular direction with respect to the annular elements, then free spaces are formed between the individual annular elements, which free spaces allow the operating medium of the electrolysis cell to flow through the holding elements, whereby effective cooling is achieved and the ohmic voltage losses are kept low.

An alternative embodiment of the invention relates to holding elements having one or more tubular portions. In cross-section, these holding elements, which are in tubular form at least in some regions, can be, for example, polygon-shaped. In particular, a lozenge shape is advantageous, in order to ensure a lower material requirement. The polygon geometry is also to be preferably symmetrical or doubly symmetrical in cross-section, in order, where possible, to obtain a deformation perpendicular to the membrane surface. If lozenge-shaped cross-sections are chosen for the tubular portions, then the holding elements are preferably arranged in one of the chambers of the electrolysis cell in such a manner that one of the diagonals of the lozenge shape extends approximately in the direction of the surface normals to the planar arrangement of electrodes.

In order in the case of the variant with tubular portions to achieve the reduced stiffness or the desired plastic deformation for minimizing the pressing force on the membrane and the electrode arrangement, through-holes are provided in the tubular portions, which through-holes can be arranged in rows, for example, and/or which extend, for example, parallel to the axis of the tubular portions. For example, these through-holes can be approximately slot-like. The material of which the tubular portions consist is weakened by the through-holes, and the plastic deformability of the holding elements is thus increased.

In principle, it is possible to use the holding elements according to the invention both on the anode side and on the cathode side of the electrolysis cell. However, it has been found within the scope of the invention that it is particularly advantageous to use them on the anode side because of the usual differential pressures and the better cooling of the structure. A slightly increased electrical resistance leads to the generation of heat, and it is possible to dissipate this heat by medium cooling on the anode side. Owing to the outlet size provided, the installation height of the anode chamber is greater than that of the cathode chamber. As a result, a greater radial extent of the elastic holding elements is possible in the anode chamber, which reduces their stiffness.

Hitherto, according to the prior art, it has been ensured that the membrane lies against the oxygen-depolarized cathode by an overpressure of, for example, approximately 200 mbar on the anode side. When the zero-gap configuration is produced mechanically according to the present invention, that overpressure can optionally be reduced. This potentially leads to a lower chlorine drift on the cathode side. This can have a positive effect, for example, on the corrosion situation (lower HCl concentration in the condensate). In addition, the absolute pressure in the cathode chamber could thus be raised to that of the anode chamber. In WO 03/014419 A2 it is described that the increased oxygen pressure at the oxygen-depolarized cathode reduces the operating voltage of the electrolysis cell.

Within the scope of the present invention it is advantageous to use comparatively thin sheet metal material for manufacturing the holding elements. In particular, it is advantageous if the annular elements and/or the webs connecting the annular elements together are manufactured from sheet metal strips having a material thickness of less than one millimeter, preferably having a material thickness of less than 0.8 mm and more than 0.4 mm, for example in the range of from approximately 0.5 mm to approximately 0.7 mm. The desired elasticities are thereby achieved with the existing installation space. In order to keep the increased ohmic pressure drop low when using thin metal sheets, the current paths in the holding element should also be kept low. On the other hand, a certain minimum material thickness is to be recommended in order to ensure a sufficient cross-section for a low-loss electrical transfer.

According to a preferred further development of the invention, an electrolysis cell comprises at least two elastoplastically resilient holding elements arranged spaced apart from one another in the longitudinal direction of the electrolysis cell. This is advantageous in order to achieve a uniform contact pressure of the planar structure comprising the ion-exchange membrane, the oxygen-depolarized cathode and the anode in larger surface regions.

According to the invention, the resilient holding elements are preferably manufactured at least in part from a metallic material, in particular from a titanium material. A titanium material is understood as meaning titanium or a titanium alloy. However, due to the passivation of the titanium material by the operating medium that is present, it is recommended to connect the resilient holding elements to adjacent components by a substance-to-substance bond. A welded connection to the adjacent components is therefore preferred.

It is, however, also possible to use other materials having sufficient electrical conductivity for use in an electrolysis cell. Such materials are in particular electrically conducting materials having a specific electrical resistance of less than 100 ohm $mm^2/m$. In particular, for electrolysis in fields of application outside HCl electrolysis, such materials can be, for example, nickel or graphite. In the field of application of HCl electrolysis, the use, for example, of tantalum, niobium or also graphite is possible.

In an electrolysis cell of the type according to the invention, a support structure is preferably arranged in the cathode chamber, which support structure comprises at least two Z-shaped profiles extending in the transverse direction of the electrolysis cell, preferably a plurality of such Z-shaped profiles which are arranged spaced apart from one another in the longitudinal direction of the electrolysis cell. When using such a support structure with Z-shaped profiles, it is advantageous according to a preferred structural form of the problem solution according to the invention if the elastoplastically resilient holding elements are arranged in the anode chamber and are in each case arranged in such a manner that, when seen in the longitudinal direction of the electrolysis cell, the resilient holding elements are each arranged offset with respect to the Z-shaped profiles. An approximately central offset of the holding elements, based on the respective spacing of two Z-shaped profiles in the cathode chamber, is particularly advantageous. As a result, the bending elasticity of the electrodes can also be used to achieve a zero-gap configuration over as large a surface portion as possible and to avoid damage to the membrane in the contact region between the holding element and the Z-shaped profiles.

It is further advantageous according to a preferred further development of the invention if, when seen in the height direction of the electrolysis cell, at least two holding elements are arranged in axial prolongation one above the other. Preferably, at least three holding elements are arranged in axial prolongation one above the other. In this manner it is possible to achieve a contact pressure and support over a predominant portion or ideally over the entire height of the electrode.

In tests within the scope of the present invention, a cell voltage of, for example, 1.30 V at 5 $kA/m^2$ was initially measured in test cells shortly after switching on. After a prolonged running time, a further reduced operating voltage of 1.25 V at 5 $kA/m^2$ could be measured. Accordingly, when the holding elements according to the invention are used, a voltage reduction in the range of from 100 to 150 mV or more is possible. This corresponds to a reduction of the energy consumption of approximately from 7.1% to 10.7% compared to a hitherto conventional cell voltage of 1.4 V at 5 $kA/m^2$.

In mechanical tests of the spring stiffness on prototypes of the above-described resilient holding elements, a membrane load of approximately 100 mbar was achieved in the case of a spring deflection of 2.5 mm.

The present invention further provides a resilient holding element for use in an electrolysis cell, for generating a contact pressure on a planar structure comprising at least two electrodes and an ion-exchange membrane, wherein the holding element is configured to be elastoplastically resilient.

Preferably, the above-mentioned resilient holding element comprises a plurality of annular elements which are arranged parallel to one another and at a distance from one another and which are connected together, or it comprises at least one tubular portion.

Preferably, in the variant of the above-mentioned resilient holding elements with annular elements, the annular elements are further connected together via webs which extend in a direction perpendicular to the plane of the annular elements.

Preferably, in the variant of the holding elements with tubular portions, those portions are provided with through-holes for reducing their stiffness.

Such a resilient holding element further preferably has one or more of the features mentioned in the above description in the explanation of the electrolysis cell according to the invention.

The present invention further provides an electrolysis cell comprising at least one holding element configured to be elastoplastically resilient having the features mentioned above.

The present invention further provides an electrolyzer comprising at least one electrolysis cell having at least one resilient holding element having the features outlined above.

Preferably, the invention provides an electrolyzer comprising at least two electrolysis cells, preferably a larger number of electrolysis cells, having the features described above, connected in series in an arrangement of the electrolysis cells in each case side by side in their transverse direction, wherein the cathode chamber of one electrolysis cell is in each case followed by the anode chamber of the adjacent electrolysis cell. Such an arrangement is also referred to as stacked single cells in a back-to-back arrangement or also bipolar or filter-press type.

Figure 8:
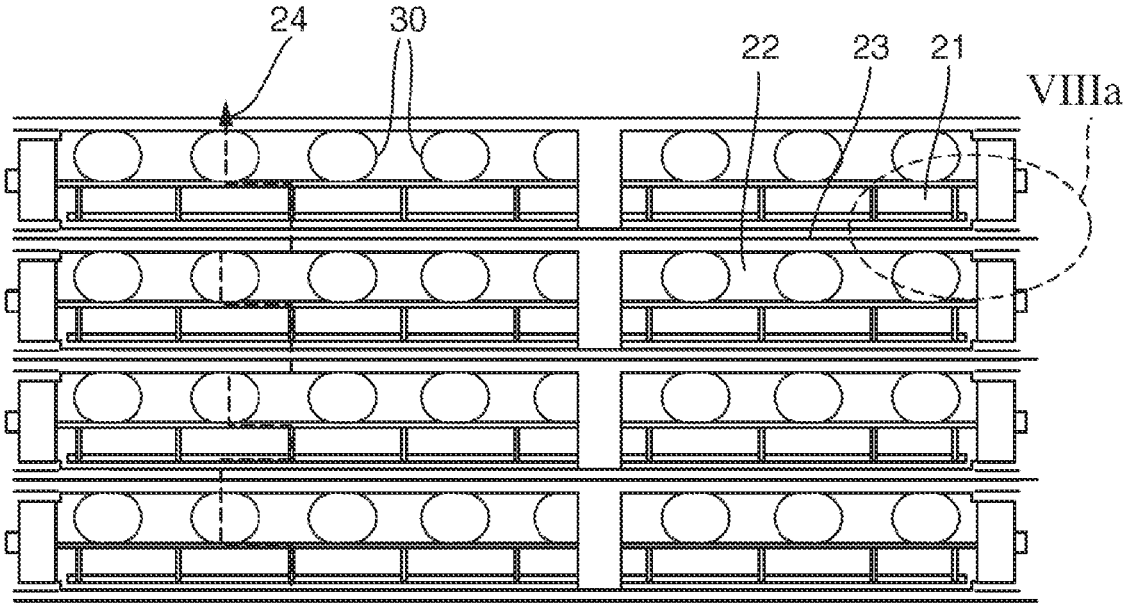
FIG. 8 is a schematic view of an arrangement of a plurality of single cells in an electrolyzer.

The fundamental construction of an electrolysis cell 10 according to the invention will first be explained in greater detail hereinbelow with reference to FIGS. 1 to 3. FIG. 1 is a view of the electrolysis cell as seen from the cathode side, but wherein the electrode itself is not shown for reasons of clarity. In the side view, the electrolysis cell 10 has in principle an approximately rectangular outline. In an electrolyzer, a larger number of elements (electrolysis cells 10) of the type shown in FIG. 1 are generally combined with one another in a block. A plurality of electrolysis cells can thereby be connected together in series in a known manner in a bipolar arrangement, wherein adjacent single cells are stacked back to back. In this structural form, the distance from anode to cathode is minimized, wherein it is ensured in the conventional structural form, by appropriate tolerancing of the rigid components, that there is only a minimal gap between an electrode and the membrane, so that damage to the membrane is ruled out. In the case of conventional cells, this is referred to as "finite-gap cells". By changing the design according to the invention and introducing the elastoplastic components, a "zero-gap cell" is obtained, that is to say the anode and cathode are separated from one another only by the ion-exchange membrane. An arrangement of a plurality of cells in series in this form is shown in FIG. 8 and will be explained in greater detail below with reference to that drawing. Since the gas diffusion electrode and the planar wire mesh on which the gas diffusion electrode is arranged, which forms the actual cathode electrode, are not shown in FIG. 1, the support structure 11 on the cathode side can be seen.

Figure 3:
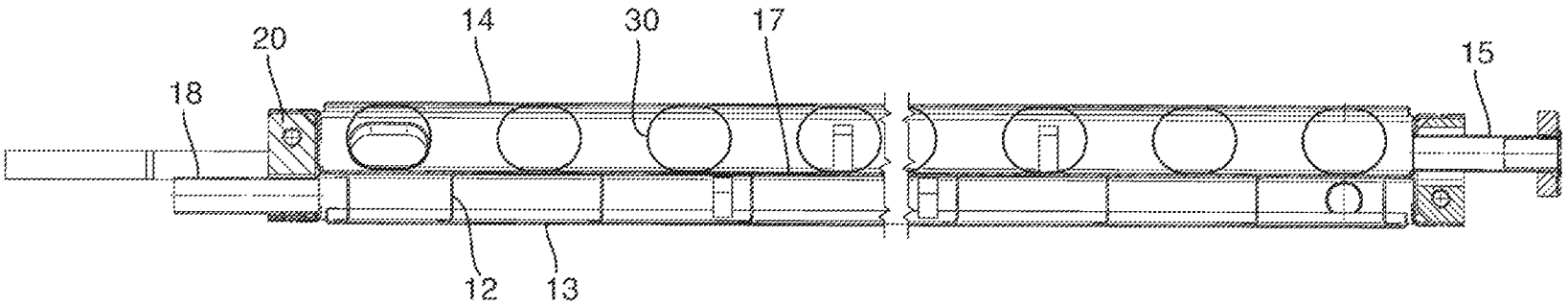
FIG. 3 is an enlarged horizontal sectional view through the electrolysis cell of FIG. 1.
Figure 4:
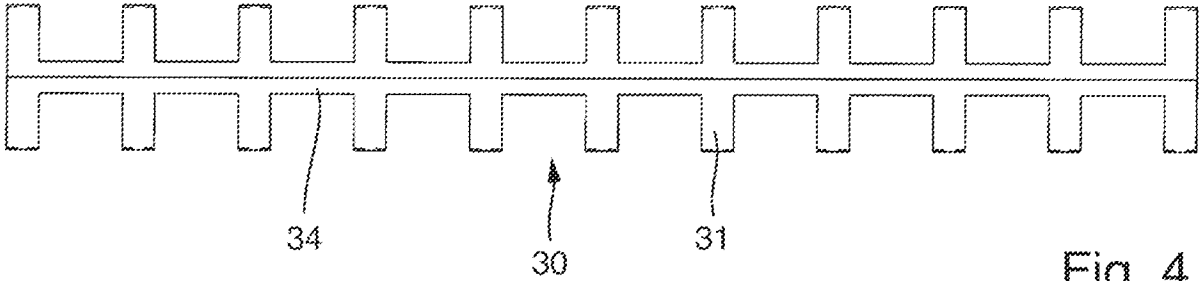
FIG. 4 is a plan view of a resilient holding element according to an exemplary variant.
Figure 5:
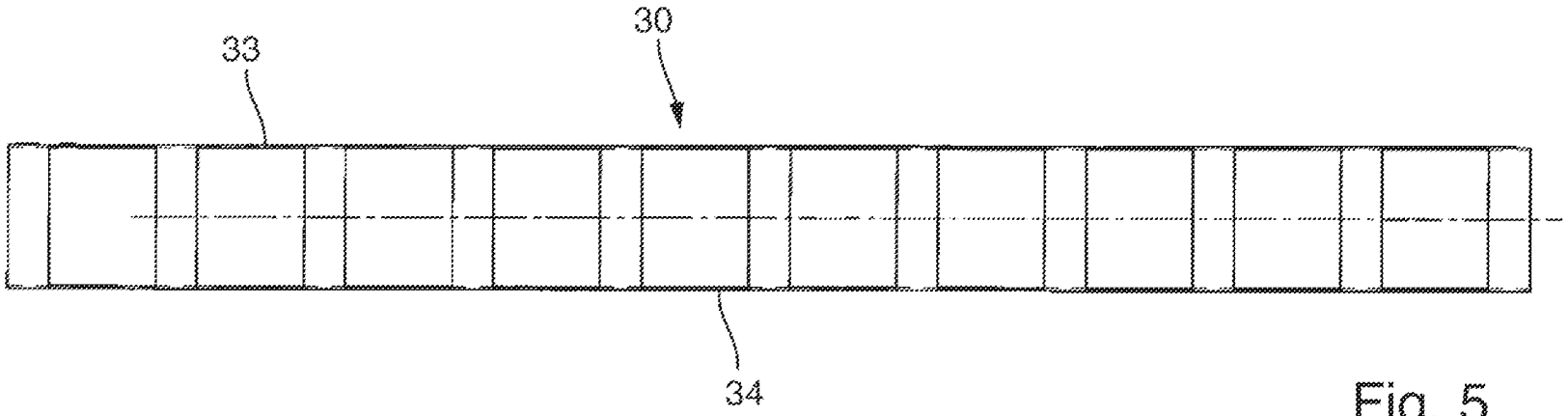
FIG. 5 is a side view of a resilient holding element according to FIG. 4.

Further details of this rigid support structure 11 on the cathode side will become apparent from the detailed representation according to FIG. 3. It will be seen that a plurality of Z-shaped profiles 12 are there arranged on the cathode side, in each case in the longitudinal direction of the electrolysis cell 10 at a distance from one another, wherein the longer leg of the "Z" extends in each case in the transverse direction of the electrolysis cell and accordingly towards the anode side. Longitudinal direction refers to the larger (horizontal) direction of extent in the rectangular outline of the electrolysis cell 10 in the drawing according to FIG. 1 from right to left. The smaller (vertical) direction of extent in the rectangular outline of the electrolysis cell in the drawing according to FIG. 1 from bottom to top is defined as the height direction. The extent of the electrolysis cell perpendicularly to the plane of the drawing in FIG. 1 is referred to as the transverse direction. The two shorter end legs of the "Z", which run approximately perpendicularly to the longer leg of the "Z", accordingly extend in the longitudinal direction of the electrolysis cell and are generally welded to further support structures, which extend in the longitudinal direction. The shorter end legs of the "Z", which are on the outside, are, as can be seen in FIG. 3, connected, for example by welding, to the cathode indicated there, which in the present application is referred to as the current distributor 13. In an electrolysis cell of this type, the actual cathode is formed by the oxygen-depolarized electrode, for which reason the cathode is referred to herein as a current distributor.

Likewise shown in FIG. 3 is the anode 14. The tubular anode liquid inlet 15 is located in FIG. 3 on the right-hand side of the drawing. The anode liquid outlet 16 extends downwards and can be seen in FIG. 2. The cathode gas inlet 18*a*, via which high-purity oxygen or an at least oxygen-rich gas, for example, can be supplied, is located in FIG. 3 on the left-hand side and accordingly lies, when seen in the longitudinal direction of the electrolysis cell 10, on the side opposite the anode liquid inlet 15. The cathode liquid outlet 19 for the condensate that forms can be seen in FIG. 2 on the bottom side of the electrolysis cell 10. The cathode gas outlet 18*b*, like the gas inlet, can be seen in FIG. 1, in the plan view of the cathode chamber.

There can additionally be seen in FIG. 3 the resilient holding elements 30 according to the invention located in the anode chamber, the function of which will be explained in greater detail hereinbelow with reference to FIGS. 4 to 7. These resilient holding elements 30 are arranged in the electrolysis cell 10 in such a manner that their axis extends in the height direction of the electrolysis cell. The resilient holding elements have in cross-section an approximately oval annular shape which is flattened slightly on both sides, and are located in the electrolysis cell 10 in such a manner that the slightly flattened regions lying opposite one another on the circumference lie on one side against the anode 14 and on the other side against the anode back wall 17. Accordingly, the holding elements 30 press the anode 14 against the membrane (see also FIG. 8) and on the other side are acted upon by the support structure of the cathode chamber, which comprises the Z-shaped profiles 12. As can be seen in FIG. 3, the holding elements 30 are, however, not situated exactly where the Z-shaped profiles 12 are located but, when seen in the longitudinal direction of the cell, are in each case offset with respect to the Z-shaped profiles 12, such that, when seen in the longitudinal direction, a holding element 30 is in each case situated preferably approximately centrally between two Z-shaped profiles 12.

Figure 2:
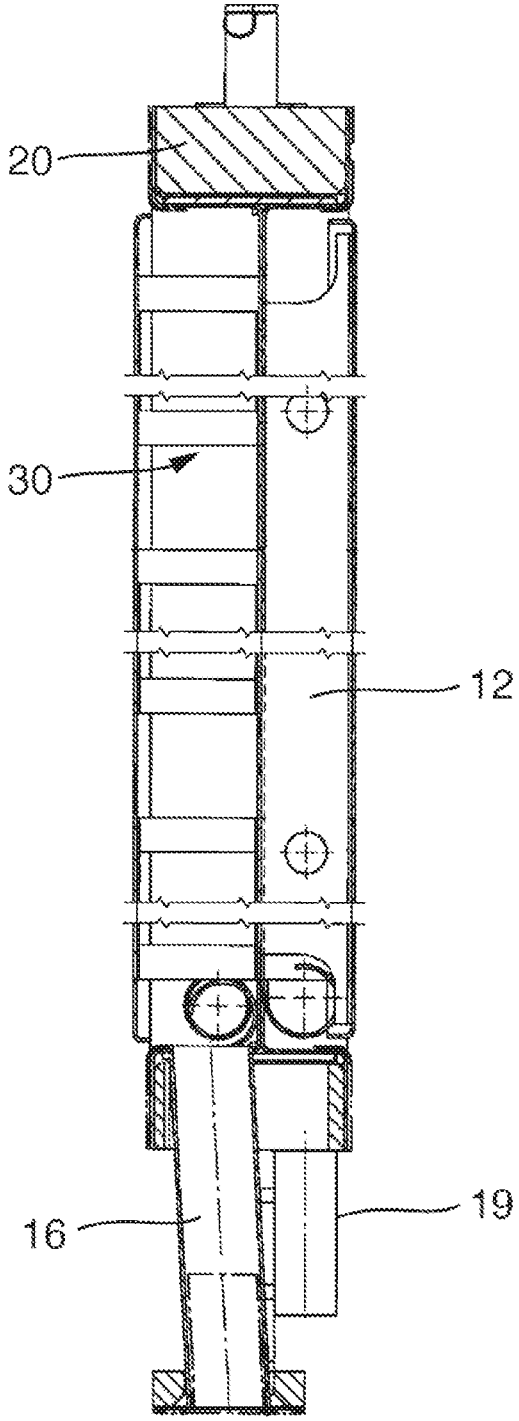
FIG. 2 is an enlarged vertical sectional view through the electrolysis cell of FIG. 1.

In FIG. 2, as in FIG. 3, the circumferential frame 20 of the electrolysis cell 10 can be seen, which frame can be capable of releasable connection to the other structural elements and which in particular serves to seal the elements with respect to one another.

To that end, the frame is in the form of, for example, solid steel material, in order optimally to support the flange surfaces of the anode and cathode chamber. The seals which seal the elements with respect to the clamped membrane are preferably placed on the flange surfaces. The required forces for sealing the cell stack are significantly greater than the forces which are necessary to deform the preferably elastoplastic components according to the invention.

In FIG. 2, the above-described resilient holding elements 30 in the anode chamber can also be seen, wherein the annular elements 31 are here visible in each case. In the exemplary embodiment, the anode chamber has a slightly greater extent than the cathode chamber in the direction of the width (transverse direction) of the electrolysis cell 10. The longer leg of one of the Z-shaped profiles 12 of the support structure in the cathode chamber can additionally be seen in FIG. 2.

Figure 6:
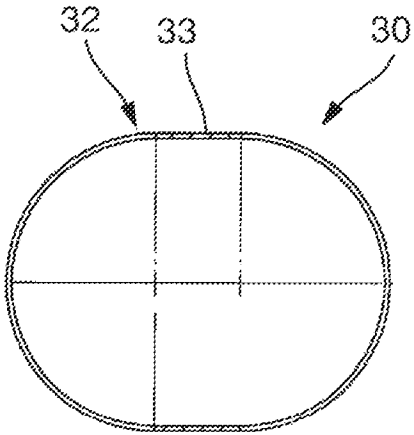
FIG. 6 is a cross-sectional view through a resilient holding element according to FIG. 5.

Reference will be made hereinbelow to FIGS. 4 to 7, and the structure of an example of a holding element 30 according to the present invention will be explained in greater detail by means of those figures. This resilient holding element 30, which in the mounted state in the electrolysis cell also deforms plastically in part, comprises a plurality of annular elements 31 which are oriented parallel to one another and are spaced apart from one another and which, as can be seen from the cross-sectional view according to FIG. 6, are not circular in outline but have a shape which is flattened slightly in each of two regions 32 lying opposite one another on the circumference and accordingly is approximately oval overall. These annular elements 31, like the resilient holding element 30 as a whole, can be manufactured from sheet metal strips having a material thickness of, for example, less than 1 mm. All the annular elements 31 of a holding element 30 are connected together via in each case two webs 33, 34, wherein the webs 33, 34 each extend in an axis-parallel direction, that is to say in the longitudinal direction of the holding element. This axis-parallel extent of the webs 33, 34 accordingly runs in each case approximately perpendicular to the circumferential direction of the annular elements 31. It is apparent from the sectional view according to FIG. 6 that the two webs 33, 34, based on the single ring element 31, are located opposite one another on the circumference, wherein the webs 33, 34 are in each case located where the annular elements 31 have the flattened regions 32.

Figure 7:
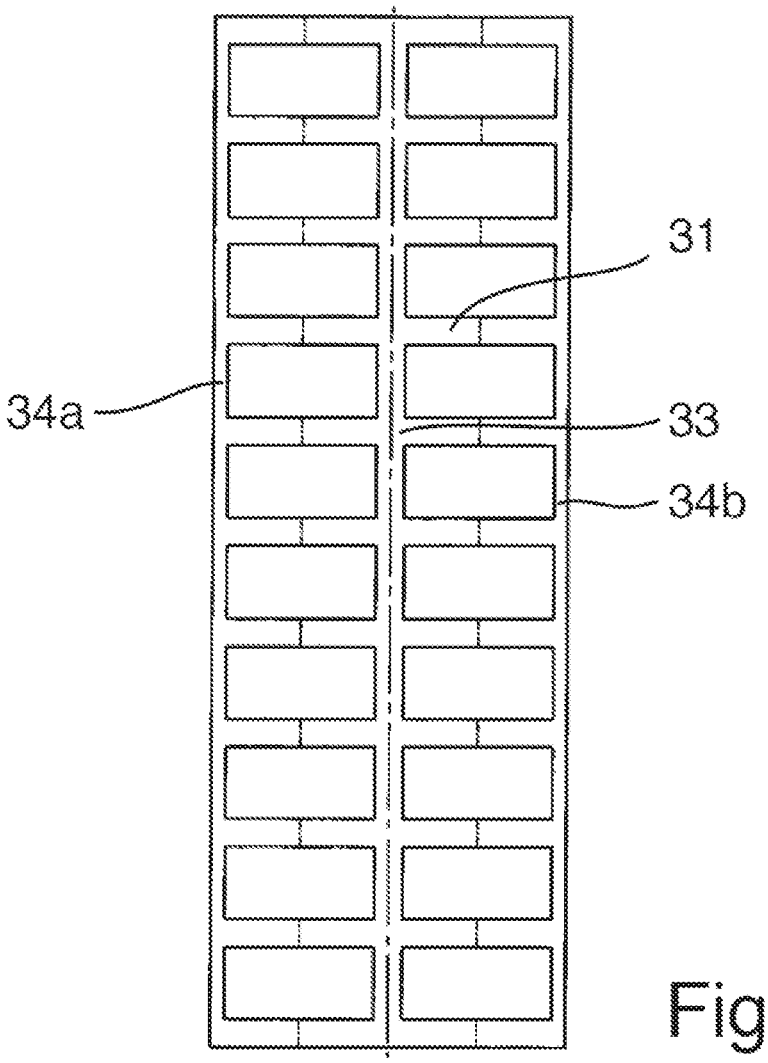
FIG. 7 is a cross-sectional view through a modification of a resilient holding element according to FIGS. 4 to 6.

FIG. 7 shows a possible modification, or an exemplary blank, of the above-described holding element 30, from which the holding element according to the invention is bent into the cylindrical form flattened on two sides which is shown in FIG. 6. There can be seen here the sheet metal strips, from which the numerous parallel annular elements 31 are formed, as well as one of the two webs 33 running in the longitudinal direction or axial direction. In the blank according to FIG. 7, half of the second web is provided at each of the edges, so that, after it has been bent into the cylindrical shape, the two halves 34*a*, 34*b* can be joined together and then form the second web 34.

The structure and function of an example of an electrolyzer having multiple electrolysis cells of the type described above connected in series will be described in greater detail hereinbelow with reference to FIGS. 8 and 8*a*. In the drawing there are shown by way of example four electrolysis cells 10 connected in series in a back-to-back arrangement, which electrolysis cells 10 are arranged in such a manner that they are located one behind the other in their transverse direction described above, such that the anode chamber and cathode chamber always alternate, wherein an ion-exchange membrane 23 is arranged in each case between a cathode chamber 21 and an anode chamber 22 of two adjacent electrolysis cells 10. The electrical current flow through the arrangement of electrolysis cells is shown in FIG. 8 by way of example and in a schematically simplified form by the meandering arrow 24, wherein the current flow actually takes place over the entire electrode surface.

Figure 8A:
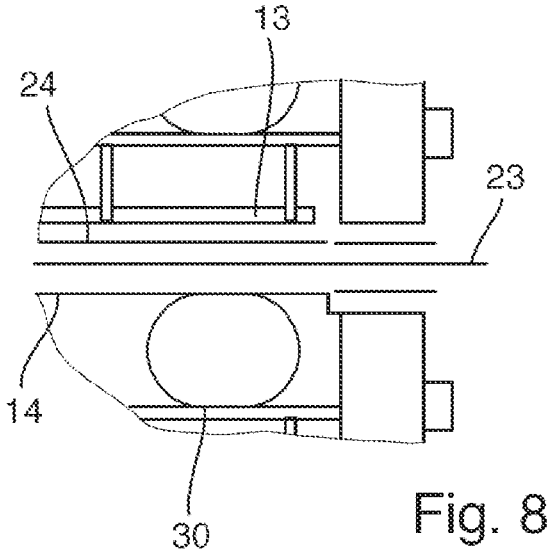
FIG. 8*a* is an enlarged detailed view of a detail from FIG. 8.

In the more detailed representation according to FIG. 8*a*, further details of the arrangement can be seen. One of the resilient holding elements 30 located in the anode chamber 22 can be seen therein in a plan view, with its flattened annular structure. The individual structural elements, when seen in the transverse direction of the arrangement, are located, starting from the second electrolysis cell from the top to the first topmost electrolysis cell, in the following order: anode 14 of the second electrolysis cell from the top, ion-exchange membrane 23, gas diffusion electrode (ODC or oxygen-depolarized cathode) 24 and cathode current distributor 13 (which belongs to the first topmost electrolysis cell). The mentioned order then continues in that manner in the arrangement of multiple electrolysis cells connected in series. It will be seen in FIG. 8*a* that the resilient holding elements 30 accordingly support the anode 14 with their annular elements 31 and press against the ion-exchange membrane 23, wherein the ion-exchange membrane in turn lies tightly against the gas diffusion electrode 24, which in turn lies tightly against the cathode current distributor 13 of the adjacent electrolysis cell, which has the Z-shaped profiles 12 as a support structure. In the drawing, a distance is shown in each case between the anode 14, the ion-exchange membrane 23 and the gas diffusion electrode 24, but this serves only to improve the representation in the drawing, that is to say the drawing is almost a partly exploded representation. The aim is actually for the anode, the ion-exchange membrane, the gas diffusion electrode and the cathode current distributor to lie tightly against one another (on one another), so that the so-called "zero-gap" configuration is obtained. This aim is assisted by the holding elements 30 according to the invention since, owing to their elastoplastic spring force and their ability to deform plastically to a certain degree, they press the anode against the gas diffusion electrode and the further planar elements of the arrangement and accordingly prevent a gap from forming therebetween.

The holding elements 30 are thereby arranged in the anode chamber in such a manner that their axis extends in the height direction of the electrolysis cell, so that pressing via the resilient and deformable annular elements 31 takes place almost in the radial direction thereof and not, as for example in the case of a helical spring for example, via a spring effect in the axial direction of the spring.

Figure 9:
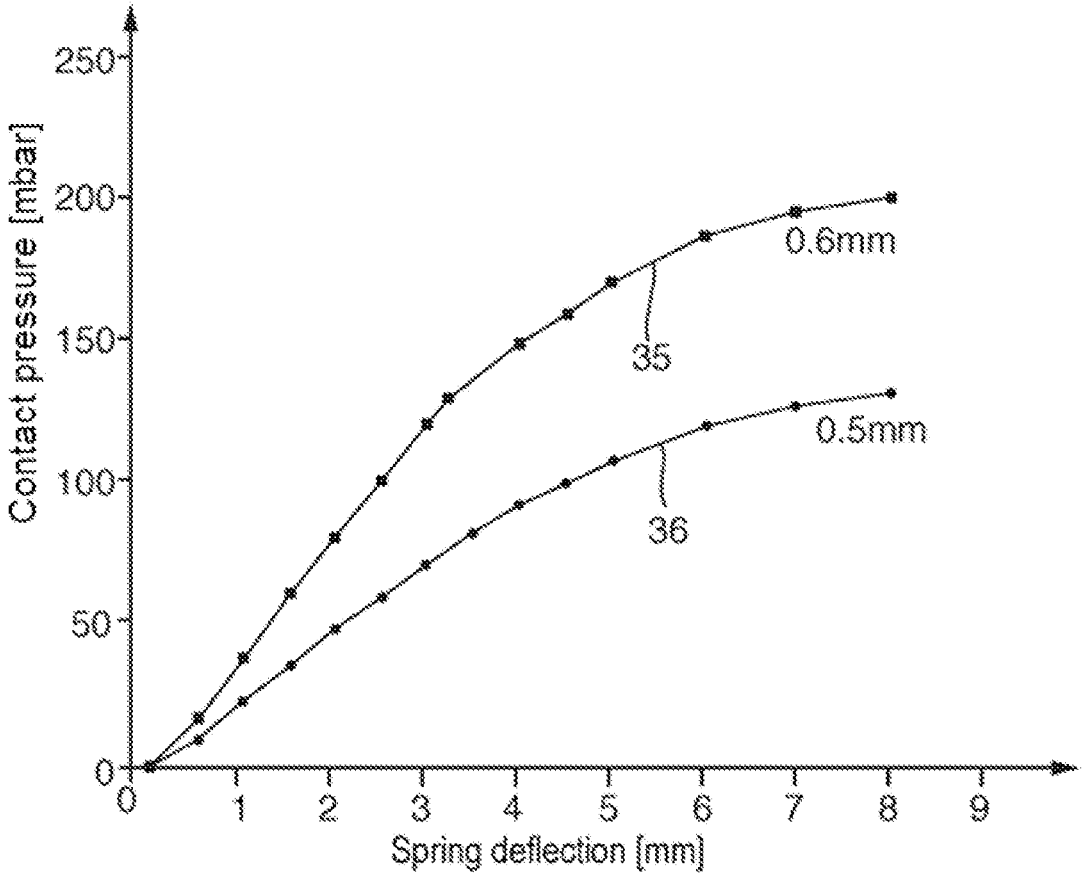
FIG. 9 is a force/path diagram which shows the average contact pressure in dependence on the spring deflection of an elastoplastically resilient holding element.

FIG. 9 shows a force/path diagram which shows the average contact pressure in mbar, based on the electrode surface, which is exerted by an elastoplastic resilient holding element according to the invention on the membrane, in dependence on the spring deflection of the annular element in mm. Two curves are recorded in the diagram. The top curve 35 is obtained from the measurements for an annular element of titanium sheet having a material thickness of 0.6 mm. The bottom curve 36 is obtained from the measurements for an annular element having a smaller material thickness of only 0.5 mm. It will be seen that the contact pressure in the case of both curves increases less and less as the spring deflection increases, so that an asymptotic approximation to the horizontal is obtained and accordingly a specific limit value for the contact pressure is not exceeded, since the annular element reacts beforehand with a plastic deformation. This limit value is lower in the case of the annular element of sheet metal having a smaller material thickness than in the case of the annular element having a greater material thickness (curve 35).

Figure 10:
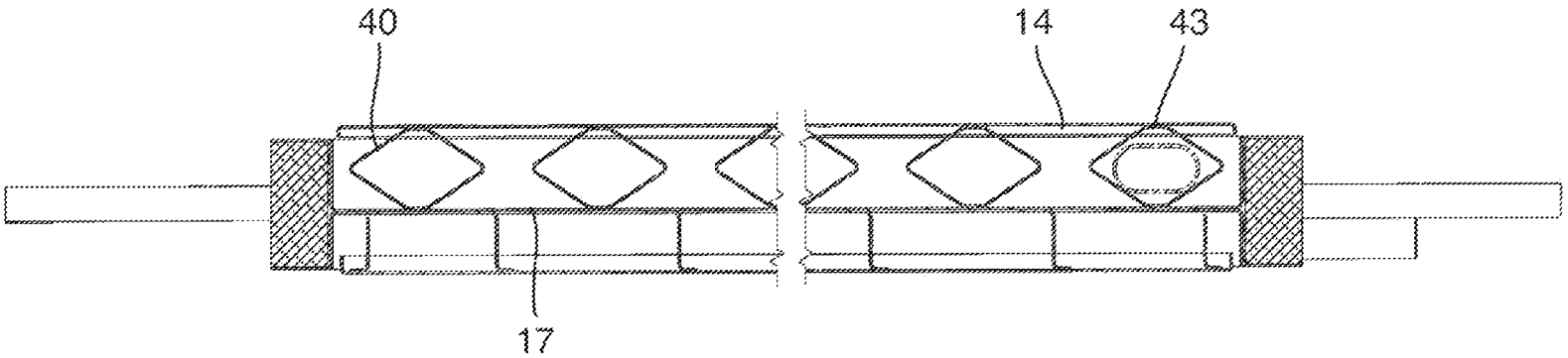
FIG. 10 is a horizontal sectional view through an electrolysis cell having an example of a holding element according to an alternative variant.

An alternative embodiment variant of the present invention will be explained hereinbelow with reference to FIGS. 10 to 12. FIG. 10 is a similar horizontal sectional view of an electrolysis cell as has already been explained above with reference to FIG. 3, so that analogous components will not be described again here. However, in this variant according to the exemplary embodiment of FIG. 10, the holding elements, which are here designated by the reference numeral 40, are of a different form. These holding elements 40, as described above, can be arranged in the anode chamber between the anode 14 and the anode back wall 17 in such a manner that they exert a contact pressure on the planar electrode structure, wherein the holding elements are flexible and to a certain degree plastically deformable in the transverse direction of the anode chamber, that is to say in the direction of the surface normals to the planar arrangement of the electrodes. In this variant, the holding elements 40 have a polygonal, for example an approximately lozenge-shaped, cross-section and are preferably loaded in the direction of one of the diagonals of that lozenge shape. In this variant too, the holding elements 40 can consist, for example, of a sheet metal material of titanium, nickel or one of the other materials mentioned above.

Figure 12:
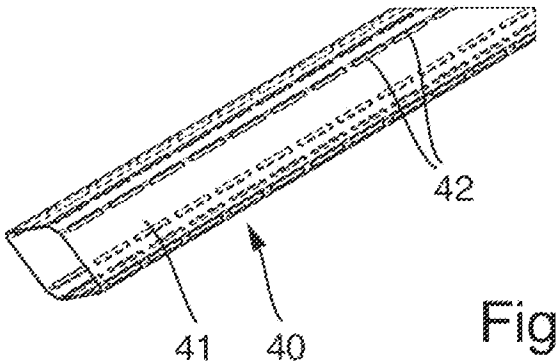
FIG. 12 is a perspective view of the holding element of FIG. 11.
Figure 11:
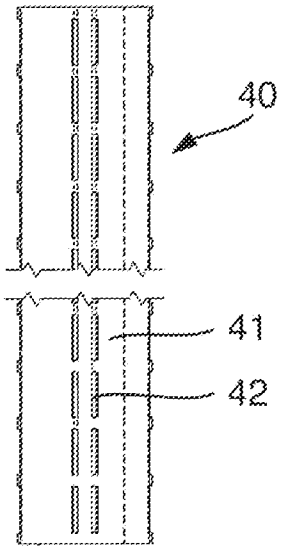
FIG. 11 is a side view of a holding element which is used in the variant of the electrolysis cell according to FIG. 10.

Further details of the lozenge shape of the holding elements 40 will become apparent from FIGS. 11 and 12, which show a side view and a perspective view, respectively, of a holding element. It will be seen that the holding elements 40, at least in some regions, have an elongate tubular form with an approximately lozenge-shaped cross-section, wherein their axial extent in the installed state corresponds to the height direction of the electrolysis cell (see also FIG. 10). In order to achieve the flexibility and optionally a certain plastic deformation in the installed state, the holding elements 40 have in their walls 41, which form tubular portions, numerous through-holes 42 or perforations, which are, for example, slot-like in form and which can be arranged in rows, in particular in multiple rows, extending in the longitudinal direction of the holding element. The otherwise tubular holding element 40 is weakened slightly by the through-holes 42, so that its stiffness decreases and the desired flexibility in the transverse direction (diagonal direction) is achieved. In FIG. 10, it will be seen that the lozenge shape of the cross-section has slight flattened portions 43 in the corner region lying against the anode 14 and in the opposite corner region, similar to the flattened regions 32 in the variant described above with reference to FIG. 3.

LIST OF REFERENCE NUMERALS

10 electrolysis cell
11 support structure
12 Z-shaped profile
13 13 current distributor
14 anode
15 anode liquid inlet
16 anode liquid outlet
17 anode back wall
18*a* cathode gas inlet
18*b* cathode gas outlet
19 cathode liquid outlet
20 circumferential frame
21 cathode chamber
22 anode chamber
23 ion-exchange membrane
24 arrow for the current flow
30 resilient holding element
31 annular element
32 flattened regions
33 axial web
34 axial web
35 top curve
36 bottom curve
40 resilient holding element
41 walls of the holding element, tubular portions
42 through-holes
43 flattened portions

What is claimed is:

1. An electrolysis cell comprising:
an anode chamber;
a cathode chamber;
an ion-exchange membrane disposed between the anode chamber and the cathode chamber;
an anode;
a cathode;
a cathode current distributor, wherein, according to the following order, the anode, the ion-exchange membrane, the cathode, and the cathode current distributor are each in direct touching contact with one another; and
resilient holding elements arranged on a side of the anode not in contact with the ion-exchange membrane and/or on a side of the cathode current distributor not in contact with the cathode, the resilient holding elements being configured to exert a contact pressure on the anode and/or on the cathode current distributor,
wherein the resilient holding elements comprise annular elements or a tubular portion, an axis of which is oriented in a height direction or in a longitudinal direction of the electrolysis cell, wherein in the electrolysis cell the resilient holding elements are configured to undergo, in addition to an elastic deformation, at least in part a plastic deformation and are configured to be elastoplastically resilient.

2. The electrolysis cell of claim 1 wherein the ion-exchange membrane, the anode, and the cathode are stronger than the resilient holding elements such that the resilient holding elements are configured to plastically deform before the ion-exchange membrane, the anode, or the cathode.

3. The electrolysis cell of claim 1 wherein the annular elements or the tubular portion of the resilient holding elements is/are disposed in the anode chamber or in the cathode chamber and is/are compression loaded in a radial direction.

4. The electrolysis cell of claim 1 wherein the resilient holding elements include the annular elements, wherein the annular elements are arranged parallel to one another, are spaced apart from one another, and are indirectly connected.

5. The electrolysis cell of claim 1 wherein the resilient holding elements include the annular elements, wherein the annular elements are connected via webs that extend in a direction perpendicular to a plane of the annular elements.

6. The electrolysis cell of claim 1 wherein the resilient holding elements include the annular elements, wherein the electrolysis cell comprises at least two webs that connect the annular elements, wherein the webs, when viewed over a circumference of the annular elements, lie approximately opposite one another.

7. The electrolysis cell of claim 1 wherein the tubular portion is a first tubular portion, wherein the resilient holding elements include the first tubular portion and a second tubular portion, with the first and second tubular portions having polygonal cross-sections.

8. The electrolysis cell of claim 1 wherein the annular elements, the tubular portion, or webs interconnecting the resilient holding elements are comprised of sheet metal that has a thickness of less than 1 mm.

9. The electrolysis cell of claim 1 comprising:
a support structure disposed in the cathode chamber; and
Z-shaped profiles extending in a transverse direction of the electrolysis cell, with the Z-shaped profiles being spaced apart from one another in the longitudinal direction of the electrolysis cell.

10. The electrolysis cell of claim 9 wherein the resilient holding elements are arranged in the anode chamber such that, when viewed in the longitudinal direction of the electrolysis cell, the resilient holding elements are offset with respect to the Z-shaped profiles.

11. An electrolysis cell comprising:
a planar structure comprising at least two electrodes that are in direct touching contact with an ion-exchange membrane; and
holding elements that are elastoplastically resilient and are configured to deform both elastically and plastically at least in part in the electrolysis cell, wherein the holding elements generate a contact pressure on the planar structure, wherein the holding elements comprise annular elements or a tubular portion, the axis of which is oriented in a height direction or in a longitudinal direction of the electrolysis cell, wherein the ion-exchange membrane is stronger than the holding elements such that the holding elements are configured to plastically deform before the ion-exchange membrane.

12. The electrolysis cell of claim 11 wherein the at least two electrodes are stronger than the holding elements such that the holding elements are configured to plastically deform before the at least two electrodes.

13. The electrolysis cell of claim 11 wherein the holding elements comprise the annular elements, wherein the annular elements are parallel to one another, are spaced apart from one another, and are indirectly connected.

14. The electrolysis cell of claim 13 wherein the annular elements are connected via webs that extend in a direction perpendicular to a plane of the annular elements.

15. The electrolysis cell of claim 11 wherein the annular elements or the tubular portion of the resilient holding elements is/are disposed in the anode chamber or in the cathode chamber and is/are compression loaded in a radial direction.

16. The electrolysis cell of claim 11 wherein the annular elements, the tubular portion, or webs interconnecting the resilient holding elements are comprised of sheet metal that has a thickness of less than 1 mm.

17. The electrolysis cell of claim 11 comprising:

a support structure disposed in a cathode chamber; and

Z-shaped profiles extending in a transverse direction of the electrolysis cell, with the Z-shaped profiles being spaced apart from one another in the longitudinal direction of the electrolysis cell, wherein the holding elements are arranged in an anode chamber such that, when viewed in the longitudinal direction of the electrolysis cell, the holding elements are offset with respect to the Z-shaped profiles.

18. An electrolysis cell comprising:

a planar structure comprising at least two electrodes that are in direct touching contact with an ion-exchange membrane; and a holding element that generates a contact pressure on the planar structure, wherein the holding element is elastoplastically resilient and is configured to deform both elastically and plastically at least in part, wherein the holding element has an annular shape or a tubular shape, wherein the ion-exchange membrane and the at least two electrodes are stronger than the holding element such that the holding element is configured to plastically deform before the ion-exchange membrane or the at least two electrodes.

* * * * *